US010783837B2

(12) United States Patent
Sun et al.

(10) Patent No.: US 10,783,837 B2
(45) Date of Patent: Sep. 22, 2020

(54) DRIVING METHOD AND DRIVING DEVICE OF DISPLAY DEVICE, AND RELATED DEVICE

(71) Applicants: BOE Technology Group Co., Ltd., Beijing (CN); Beijing BOE Optoelectronics Technology Co., Ltd., Beijing (CN)

(72) Inventors: Yilang Sun, Beijing (CN); Yifang Chu, Beijing (CN); Tiankuo Shi, Beijing (CN); Zhihua Ji, Beijing (CN); Lingyun Shi, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 5 days.

(21) Appl. No.: 16/235,201

(22) Filed: Dec. 28, 2018

(65) Prior Publication Data

US 2019/0355313 A1 Nov. 21, 2019

(30) Foreign Application Priority Data

May 18, 2018 (CN) ..... 2018 1 0482490

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01)

(58) Field of Classification Search
CPC ..... G09G 3/3406; G09G 3/3607
See application file for complete search history.

(56) References Cited

U.S. PATENT DOCUMENTS

2010/0321587 A1* 12/2010 Kerofsky ..... G09G 3/3611 348/730

* cited by examiner

*Primary Examiner* — Lisa S Landis
(74) *Attorney, Agent, or Firm* — Arent Fox LLP; Michael Fainberg

(57) ABSTRACT

Disclosed are a driving method and driving device of a display device, and a related device. After the backlight signal value of the backlight area is subjected to peak driving, the backlight signal value of each backlight area subjected to peak driving is subjected to backlight diffusion to obtain the backlight signal value of each pixel, and then the output luminance value of each pixel is determined according to the backlight signal value of each pixel and the relationship between the corresponding grayscale value when the backlight module is always on and the peak driving threshold, so as to perform display control.

16 Claims, 5 Drawing Sheets

Relationship between pixel grayscale and backlight luminance

Relationship between pixel grayscale and transmittance

Relationship between pixe grayscale and display luminance

DRIVING METHOD AND DRIVING DEVICE OF DISPLAY DEVICE, AND RELATED DEVICE

CROSS-REFERENCE TO RELATED APPLICATION

This application claims priority of Chinese Patent Application No. 201810482490.1, filed on May 18, 2018, which is hereby incorporated by reference in its entirety.

FIELD

The present disclosure relates to the field of display technology, particularly to a driving method and driving device of a display device, and a display device.

BACKGROUND

High Dynamic Range (HDR) technology is a technology that improves image contrast and makes the image display better, and has become an industry trend. At present, the HDR technology is realized by combining the local diming technology and the peak driving technology to achieve a display effect of making the bright positions brighter and dark positions darker.

SUMMARY

Some embodiments of the present disclosure provide a driving method of a display device, including:

determining, according to an input luminance value of each pixel in an input image to be displayed, a backlight signal value of each backlight area in a backlight module;

performing, under a condition that a total power consumption after an adjustment is smaller than the corresponding power consumption when the backlight module is always on, peak driving on at least part of backlight areas in which the backlight signal values are greater than a preset peak driving threshold;

determining, according to a preset backlight diffusion function and the backlight signal value of each of the backlight areas subjected to peak driving, a backlight signal value of each pixel corresponding to each of the backlight areas;

determining, according to the backlight signal value of each of the pixels and the relationship between the corresponding grayscale value when the backlight module is always on and the peak driving threshold, an output luminance value of each of the pixels; and driving, according to the determined output luminance value of each of the pixels, a liquid crystal display panel; and driving, according to the backlight signal value of each of the backlight areas subjected to peak driving, the backlight module.

In a possible implementation manner, in the driving method provided by some embodiments of the present disclosure, the performing, under the condition that the total power consumption after the adjustment is smaller than the corresponding power consumption when the backlight module is always on, peak driving on at least part of backlight areas in which the backlight signal values are greater than a preset peak driving threshold, includes:

determining, according to the backlight signal value of each of the backlight areas and the corresponding grayscale value when the backlight module is always on, a maximum power consumption allowance;

sorting backlight areas of which the averages of the input luminance values of pixels are greater than the peak driving threshold from high to low; and performing driving and on the backlight signal values of all sorted backlight areas one by one by a set multiple until confirming that the sum of all driving increments is smaller than the maximum power consumption allowance.

In a possible implementation manner, in the driving method provided by some embodiments of the present disclosure, the determining, according to the backlight signal value of each of the pixels and the relationship between the corresponding grayscale value when the backlight module is always on and the peak driving threshold, an output luminance value of each of the pixels, includes:

increasing, in response to that the backlight signal value of the pixel is lower than the corresponding grayscale value when the backlight module is always on, the output luminance value of the pixel based on the input luminance value of the pixel;

decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel; and performing, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel.

In a possible implementation manner, in the driving method provided by some embodiments of the present disclosure, the increasing, in response to that the backlight signal value of the pixel is lower than the corresponding grayscale value when the backlight module is always on, the output luminance value of the pixel based on the input luminance value of the pixel, includes:

determining, in response to that the backlight signal value of the pixel is lower than the corresponding grayscale value when the backlight module is always on, the output luminance value of the pixel according to the following formula:

$$V=V_0+(bl_{max}-b_{psf})*V_0/N;$$

wherein, V represents the output luminance value of the pixel, $V_0$ represents the input luminance value of the pixel, $bl_{psf}$ represents the backlight signal value of the pixel, $bl_{max}$ represents the maximum value in the backlight signal values of all the pixels, and N represents the corresponding grayscale value when the backlight module is always on.

In a possible implementation manner, in the driving method provided by some embodiments of the present disclosure, the decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel, includes:

determining, in response to that the backlight signal value of the pixel is higher than the corresponding grayscale value when the backlight module is always on, and the input luminance value of the pixel is smaller than the peak driving threshold, the output luminance value of the pixel according to the following formula:

$$V=V_0*(N/bl_{psf});$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on.

In a possible implementation manner, in the driving method provided by some embodiments of the present disclosure, the performing, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, includes:

determining, in response to that the backlight signal value of the pixel is higher than the corresponding grayscale value when the backlight module is always on, and the input luminance value of the pixel is greater than the peak driving threshold, the output luminance value of the pixel according to the following formula:

$$V=((N-T*(N/bl_{psf}))/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on.

In a possible implementation manner, in the driving method provided by some embodiments of the present disclosure, the decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel, includes:

determining, in response to that the backlight signal value of the pixel is higher than the corresponding grayscale value when the backlight module is always on, and the input luminance value of the pixel is smaller than the peak driving threshold, the output luminance value of the pixel according to the following formula:

$$V=V_0*((N+(bl_{psf}-N)/a)/bl_{psf})^{(1/\gamma)};$$

wherein, V represents the output luminance value of the pixel, $V_0$ represents the input luminance value of the pixel, $bl_{psf}$ represents the backlight signal value of the pixel, a is a positive number greater than 1, and N represents the corresponding grayscale value when the backlight module is always on.

In a possible implementation manner, in the driving method provided by some embodiments of the present disclosure, the performing, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, includes:

determining, in response to that the backlight signal value of the pixel is higher than the corresponding grayscale value when the backlight module is always on, and when the input luminance value of the pixel is greater than the peak driving threshold, the output luminance value of the pixel according to the following formula:

$$V=((N-T*(N+(bl_{psf}-N)/a)/bl_{psf})^{(1/\gamma)}/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, and N represents the corresponding grayscale value when the backlight module is always on.

In another aspect, some embodiments of the present disclosure further provide a driving device of a display device, including:

a local dimming circuit, configured to determine, according to an input luminance value of each pixel in an input image to be displayed, a backlight signal value of each backlight area in a backlight module;

a peak driving circuit, configured to perform, under a condition that a total power consumption after the adjustment is smaller than the corresponding power consumption when the backlight module is always on, peak driving on at least part of backlight areas in which the backlight signal values are greater than a preset peak driving threshold;

a backlight diffusion circuit, configured to determine, according to a preset backlight diffusion function and the backlight signal value of each of the backlight areas subjected to peak driving, a backlight signal value of each pixel corresponding to each of the backlight areas;

a luminance compensation circuit, configured to determine, according to the backlight signal value of each of the pixels and a relationship between the corresponding grayscale value when the backlight module is always on and the peak driving threshold, an output luminance value of each of the pixels;

a panel drive circuit, configured to drive, according to the determined output luminance value of each of the pixels, a liquid crystal display panel; and a backlight drive circuit, configured to drive, according to the backlight signal value of each of the backlight areas subjected to peak driving, the backlight module.

In a possible implementation manner, in the driving device provided by some embodiments of the present disclosure, the peak driving circuit is configured to determine, according to the backlight signal value of each of the backlight areas and the corresponding grayscale value when the backlight module is always on, a maximum power consumption allowance; sort backlight areas of which the averages of the input luminance values of pixels are greater than the peak driving threshold from high to low; and perform driving on the backlight signal values of all the sorted backlight areas one by one by a set multiple until confirming that the sum of all driving increments is smaller than the maximum power consumption allowance.

In a possible implementation manner, in the driving device provided by some embodiments of the present disclosure, the luminance compensation circuit is configured to increase, in response to that the backlight signal value of the pixel is lower than the corresponding grayscale value when the backlight module is always on, the output luminance value of the pixel based on the input luminance value of the pixel; decrease, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel; and perform, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel.

In a possible implementation manner, in the driving device provided by some embodiments of the present disclosure, the luminance compensation circuit is configured to determine, in response to that the backlight signal value of the pixel is lower than the corresponding grayscale value when the backlight module is always on, the output luminance value of the pixel according to the following formula:

$$V=V_0+(bl_{max}-bl_{psf})*V0/N;$$

wherein, V represents the output luminance value of the pixel, $V_0$ represents the input luminance value of the pixel, $bl_{psf}$ represents the backlight signal value of the pixel, $bl_{max}$ represents the maximum value in the backlight signal values of all the pixels, and N represents the corresponding grayscale value when the backlight module is always on.

In a possible implementation manner, in the driving device provided by some embodiments of the present disclosure, the luminance compensation circuit is configured to determine, in response to that the backlight signal value of the pixel is higher than the corresponding grayscale value when the backlight module is always on, and the input luminance value of the pixel is smaller than the peak driving threshold, the output luminance value of the pixel according to the following formula:

$$V=V_0*(N/bl_{psf});$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on.

In a possible implementation manner, in the driving device provided by some embodiments of the present disclosure, the luminance compensation circuit is configured to determine, in response to that the backlight signal value of the pixel is higher than the corresponding grayscale value when the backlight module is always on, and the input luminance value of the pixel is greater than the peak driving threshold, the output luminance value of the pixel according to the following formula:

$$V=((N-T*(N/bl_{psf}))/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on.

In a possible implementation manner, in the driving device provided by some embodiments of the present disclosure, the luminance compensation circuit is configured to determine, in response to that the backlight signal value of the pixel is higher than the corresponding grayscale value when the backlight module is always on, and the input luminance value of the pixel is smaller than the peak driving threshold, the output luminance value of the pixel according to the following formula:

$$V=V_0*((N+(bl_{psf}-N)/a)/bl_{psf})^{(1/\gamma)};$$

wherein, V represents the output luminance value of the pixel, $V_0$ represents the input luminance value of the pixel, $bl_{psf}$ represents the backlight signal value of the pixel, a is a positive number greater than 1, and N represents the corresponding grayscale value when the backlight module is always on.

In a possible implementation manner, in the driving device provided by some embodiments of the present disclosure, the luminance compensation circuit is configured to determine, in response to that the backlight signal value of the pixel is higher than the corresponding grayscale value when the backlight module is always on, and the input luminance value of the pixel is greater than the peak driving threshold, the output luminance value of the pixel according to the following formula:

$$V=((N-T*(N+(bl_{psf}-N)/a)/bl_{psf})^{(1/\gamma)})/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, and N represents the corresponding grayscale value when the backlight module is always on.

In another aspect, some embodiments of the present disclosure further provide a display device, including the foregoing driving device provided by some embodiments of the present disclosure.

In another aspect, a computer readable medium includes program codes, wherein when the program codes are run on a computing device, the program codes are configured to enable the computing device to execute the foregoing driving method provided by some embodiments of the present disclosure.

DETAILED DESCRIPTION OF THE EMBODIMENTS

In order to make the objects, technical solutions and advantages of the present disclosure more apparent, the present disclosure will be further described in detail with reference to the accompanying drawings. It is apparent that the described embodiments are only a part of the embodiments of the present disclosure, and not all of the embodiments. All other embodiments obtained by those of ordinary skill in the art based on the embodiments of the present disclosure without creative work are within the protection scope of the present disclosure.

Figure 1:
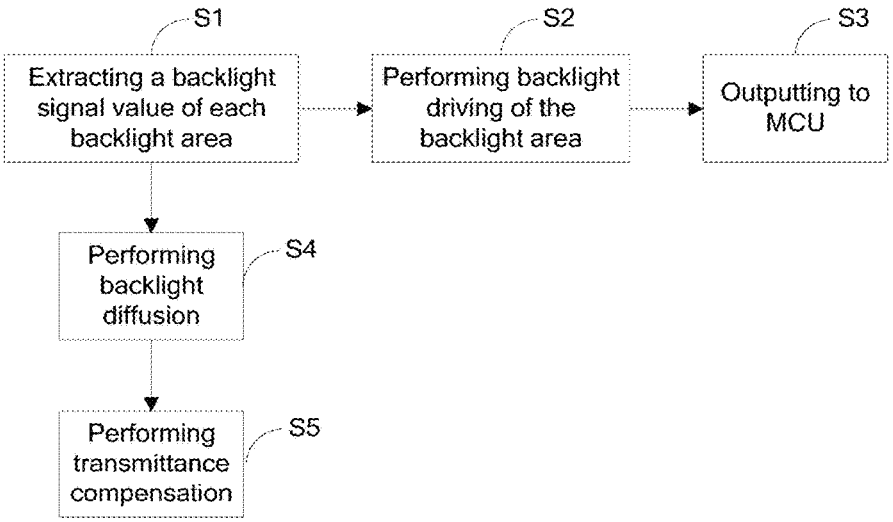
FIG. 1 is a schematic flow chart of a driving method of a display device of the related art.

The existing HDR method is shown in FIG. 1, and includes the following steps: S1, extracting a backlight signal value of each backlight area by local dimming; S2, when it is determined that the backlight signal value of the backlight area is greater than a set driving (peak) threshold, increasing the backlight signal value of the backlight area by L times by peak driving, that is, performing backlight driving of the backlight area; S3, directly outputting the backlight signal value after the backlight driving to an MCU for backlight control; S4, performing backlight diffusion on the backlight signal value output in step S1 by a backlight diffusion function to obtain a backlight signal value of each pixel as a basis for transmittance compensation of a display panel; and S5, performing compensation on the transmittance of the display panel by addition compensation, that is, adjusting the luminance of each pixel of the display panel.

When compensation is performed on the transmittance of the display panel in steps S4 and S5, the actual backlight change is not referred to, the backlight signal value output in step S1 is adopted, that is, only the backlight signal value reduced in local dimming is compensated during transmittance compensation, and the backlight signal value subjected to peak driving is not compensated, that is, the addition compensation method of step S5 can only deal with the backlight reduction, thereby causing a mismatch between the transmittance adjustment and the backlight change, that is, the transmittance of the display panel corresponding to the backlight area of which the backlight signal value is increased in step S2 is not adjusted. Since the display luminance is equal to the product of the backlight luminance and the transmittance, the display luminance of the backlight area in the backlight driving position is greater than that of other areas, that is, a bright block problem occurs.

Figure 3A:
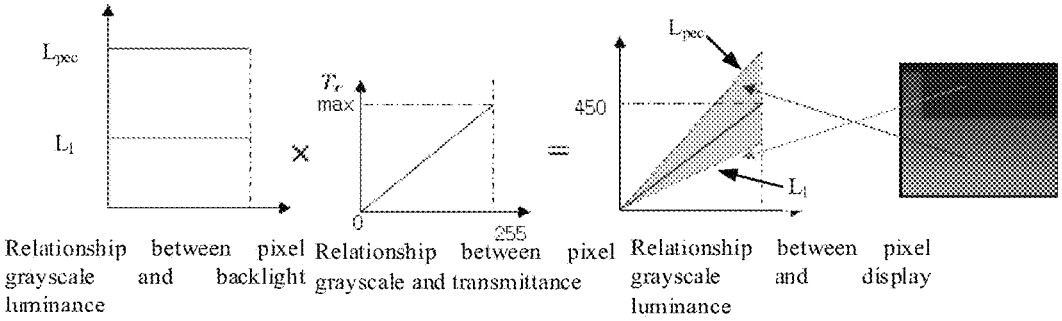
FIG. 3A is a schematic diagram showing the relationship between display luminance and pixel grayscale in the related art.

As shown in FIG. 3A, cases that the backlight luminance multiplied by the transmittance is equal to the display luminance are shown, wherein each abscissa is a pixel grayscale. The relationship between the pixel grayscale (pixel luminance value) and the backlight luminance shows the backlight luminance $L_{pec}$ that is higher than the grayscale value when the backlight module is always on (generally 255), namely the backlight signal value subjected to backlight driving, and also shows the backlight luminance $L_1$ that is lower than the grayscale value when the backlight module is always on, namely the backlight signal value not subjected to backlight driving, that is, the backlight signal value subjected to local dimming. The relationship between the pixel grayscale (pixel luminance value) and the transmittance shows a single correspondence between the transmittance and the pixel grayscale when the backlight driving is not considered, therefore, two correspondences appear in the obtained relationship between the pixel grayscale (pixel luminance value) and the display luminance. These two correspondences cause the display luminance to be discontinuous, forming a brightness partition. In the actual display image shown on the right side of FIG. 3A, a bright block problem occurs in the display areas corresponding to different correspondences between the pixel grayscale and the display luminance.

Figure 2:
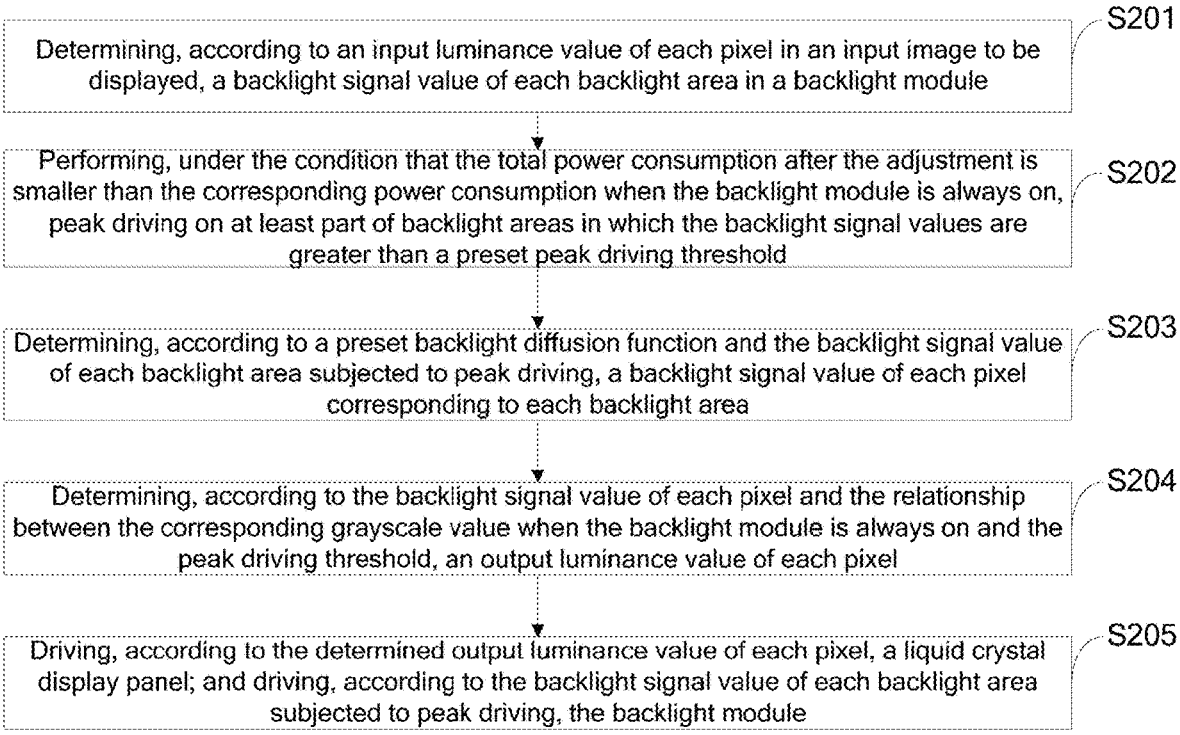
FIG. 2 is a schematic flow chart of a driving method of a display device according to some embodiments of the present disclosure.

Based on this, some embodiments of the present disclosure provide a driving method of a display device, as shown in FIG. 2, including:

S201: determining, according to an input luminance value of each pixel in an input image to be displayed, a backlight signal value of each backlight area in a backlight module;

S202: performing, under the condition that the total power consumption after the adjustment is smaller than the corresponding power consumption when the backlight module is always on, peak driving on at least part of backlight areas in which the backlight signal values are greater than a preset peak driving threshold;

S203: determining, according to a preset backlight diffusion function and the backlight signal value of each backlight area subjected to peak driving, a backlight signal value of each pixel corresponding to each backlight area;

S204: determining, according to the backlight signal value of each pixel and the relationship between the corresponding grayscale value when the backlight module is always on and the peak driving threshold, an output luminance value of each pixel; and S205: driving, according to the determined output luminance value of each pixel, a liquid crystal display panel; and driving, according to the backlight signal value of each backlight area subjected to peak driving, the backlight module.

Optionally, in the driving method provided by some embodiments of the present disclosure, after the backlight signal value of the backlight area is subjected to peak driving, backlight diffusion is performed on the backlight signal value of each backlight area subjected to peak driving to obtain the backlight signal value of each pixel, and then a three-stage compensation manner is adopted to determine the output luminance value of each pixel according to the backlight signal value of each pixel and the relationship between the corresponding grayscale value when the backlight module is always on and the peak driving threshold, so as to perform display control. When transmittance compensation is performed, that is, when the output luminance value of each pixel is determined, the backlight signal value of each backlight area subjected to peak driving is adopted, and therefore, as compared to the existing addition compensation that can only deal with backlight reduction, the backlight signal value of any backlight change can be compensated, so that the adjusted transmittance and the backlight change match each other, thereby avoiding the bright block problem and further improving the display effect.

Optionally, in the driving method provided by the embodiment of the present disclosure, since data of the input image to be displayed is generally grayscale data of each pixel, before performing step S201 of determining, according to an input luminance value of each pixel in an input image to be displayed, a backlight signal value of each backlight area in a backlight module, it is generally required to convert the received grayscale data of each pixel in the image to be displayed into an input luminance value of each pixel; specifically, the input RGB data signal is converted into an HSV color space, and the V value therein is selected; wherein H is hue, S is saturation, and V is lightness value, i.e. input luminance value. Further, when step S205 of driving, according to the determined output luminance value of each pixel, a liquid crystal display panel is performed, it is generally required to convert the output luminance value of each pixel from the HSV color space into the RGB data signal for display.

Figure 4:
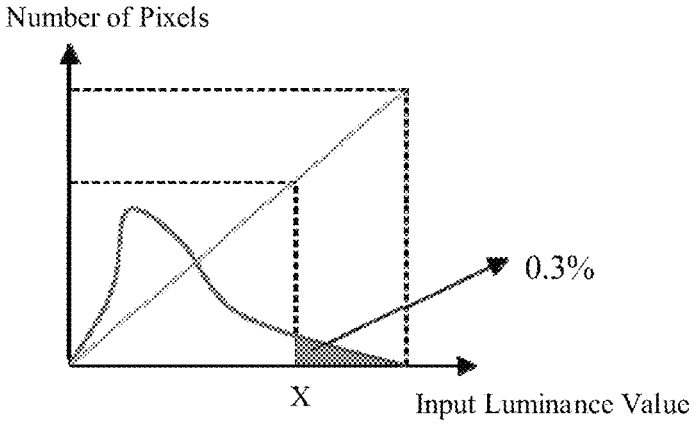
FIG. 4 is a schematic diagram of extracting a backlight signal value in a driving method of a display device according to some embodiments of the present disclosure.

Optionally, in the driving method provided by the embodiment of the present disclosure, step S201 of determining, according to an input luminance value of each pixel in an input image to be displayed, a backlight signal value of each backlight area in a backlight module is to extract the backlight signal value of each backlight area, and can be specifically implemented in the following ways:

firstly, according to the input luminance value of each pixel corresponding to each backlight area, the histogram statistics are performed on each backlight area; optionally, after the histogram statistics are performed, the distribution of the number of pixels of different brightness values corresponding to the backlight areas is obtained, for example, as shown in FIG. 4; and then, the input luminance value X, where the percentage of the accumulation result of the corresponding number of pixels after the input luminance values are sorted from high to low in the total number of pixels in the picture corresponding to the backlight area is the set threshold, for example, 0.3%, is used as the backlight signal value of the backlight area, as shown in FIG. 4.

In the manner of extracting the backlight signal value of each backlight area, the backlight signal value is obtained by using a statistical method mainly by performing statistics on the input luminance values of all the pixels in the backlight area. The obtained backlight signal value can better display the image corresponding to the backlight area (no detail loss) and will not distort the image.

Alternatively, step S201 of determining, according to an input luminance value of each pixel in an input image to be displayed, a backlight signal value of each backlight area in a backlight module is to extract the backlight signal value of each backlight area, or may also be implemented in other manners. For example, the average of the input luminance values of all the pixels in the backlight area is used as the backlight signal value, which is not limited herein.

Figure 5:
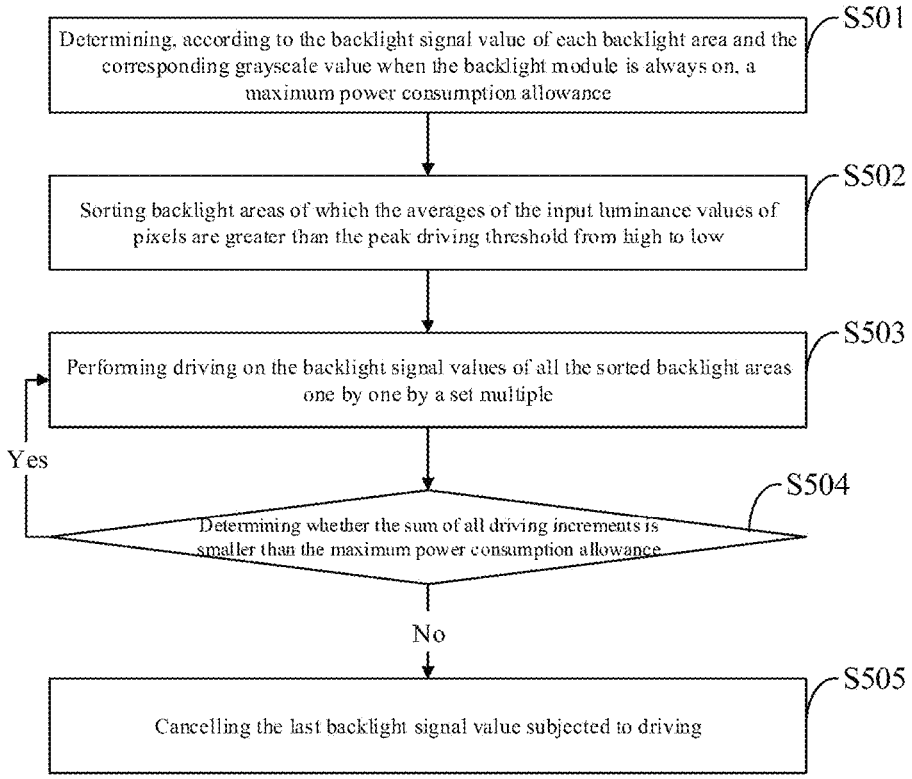
FIG. 5 is a schematic flow chart of a driving method of a display device according to some embodiments of the present disclosure.

Optionally, in the driving method provided by the embodiment of the present disclosure, step S202 of performing, under the condition that the total power consumption after the adjustment is smaller than the corresponding power consumption when the backlight module is always on, peak driving on at least part of backlight areas in which the backlight signal values are greater than a preset peak driving threshold, as shown in FIG. 5, may specifically include:

S501: determining, according to the backlight signal value of each backlight area and the corresponding grayscale value when the backlight module is always on, a maximum power consumption allowance; optionally, the backlight signal values of all the backlight areas may be accumulated to obtain a first total power consumption value, then the corresponding grayscale value when the backlight module is always on, generally 255, is multiplied by the number of pixels to obtain a second total power consumption value when the backlight module is always on, and finally, the second total power consumption value minus the first total power consumption value is the maximum power consumption allowance;

S502: sorting backlight areas of which the averages of the input luminance values of pixels are greater than the peak driving threshold P from high to low; optionally, the average of the input luminance values of the pixels of each backlight area may be firstly calculated, then the averages are sorted from high to low, and finally, the sorted backlight areas of which the averages are greater than the peak driving threshold P are selected; alternatively, the average of the input luminance values of the pixels of each backlight area may be firstly calculated, then the backlight areas of which the averages are greater than the peak driving threshold P are selected, and finally, the averages that are greater than the peak driving threshold P are sorted from high to low;

S503: performing driving on the backlight signal values of all the sorted backlight areas one by one by a set multiple;

S504: determining whether the sum of all driving increments is smaller than the maximum power consumption allowance; if yes, returning to S503; if no, executing step S505; and S505: cancelling the last backlight signal value subjected to driving.

For example, after the backlight signal value of the sorted first backlight area is subjected to driving, if it is determined that the driving increment (the amount of change before and after driving) is smaller than the maximum power consumption allowance, then the backlight signal value of the sorted second backlight area is subjected to driving; if it is determined that the sum of the driving increment of the second driving and the driving increment of the first driving is smaller than the maximum power consumption allowance, then the backlight signal value of the sorted third backlight area is subjected to driving; and in a similar fashion, for example, after the backlight signal value of the sorted fifth backlight area is subjected to driving, if the sum of the driving increments is greater than the maximum power consumption allowance, then the driving of the backlight signal value of the sorted fifth backlight area is canceled, that is, the final result is that the backlight signal values of the sorted first to fourth backlight areas are subjected to driving.

Figure 6:
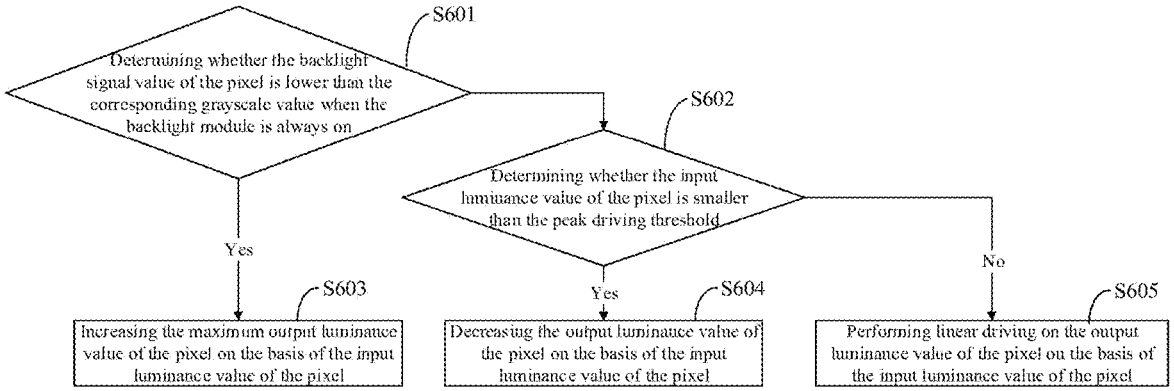
FIG. 6 is another schematic flow chart of a driving method of a display device according to some embodiments of the present disclosure.

Optionally, in the driving method provided by the embodiment of the present disclosure, step S204 of determining, according to the backlight signal value of each pixel and the relationship between the corresponding grayscale value when the backlight module is always on and the peak driving threshold, an output luminance value of each pixel, as show in FIG. 6, may be specifically implemented by the following steps:

S601: determining whether the backlight signal value of the pixel is lower than the corresponding grayscale value when the backlight module is always on; if yes, executing step S603; if no, executing step S602;

S602: determining whether the input luminance value of the pixel is smaller than the peak driving threshold; if yes, executing step S604; if no, executing step S605;

S603: increasing the output luminance value of the pixel based on the input luminance value of the pixel;

S604: decreasing the output luminance value of the pixel based on the input luminance value of the pixel; and S605: performing linear driving on the output luminance value of the pixel based on the input luminance value of the pixel.

Figure 3B:
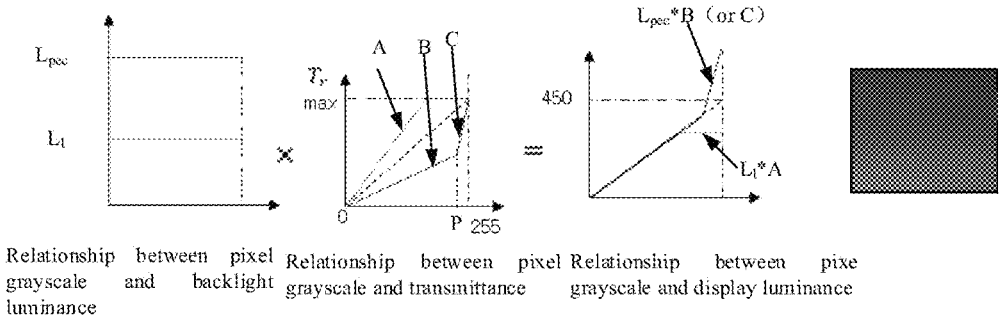
FIG. 3B is a schematic diagram showing the relationship between display luminance and pixel grayscale according to some embodiments of the present disclosure.

As shown in FIG. 3B, cases that the backlight luminance multiplied by the transmittance is equal to the display luminance when the three-stage compensation manner in the driving method provided by embodiments of the present disclosure is adopted are shown, wherein each abscissa is are the pixel grayscale. The relationship between the pixel grayscale (pixel luminance value) and the backlight luminance shows the backlight luminance $L_{pec}$ that is higher than the grayscale value when the backlight module is always on, that is, the backlight signal value subjected to backlight driving, and also shows the backlight luminance $L_1$ that is lower than the grayscale value when the backlight module is always on, that is, the backlight signal value not subjected to backlight driving, that is, the backlight signal value subjected to local dimming. The relationship between the pixel grayscale (pixel luminance value) and the transmittance shows the three-stage compensation manner, wherein the case of increasing the output luminance value of the pixel based on the input luminance value of the pixel is represented by A, the case of decreasing the output luminance value of the pixel based on the input luminance value of the pixel is represented by B, and the case of performing linear driving on the output luminance value of the pixel based on the input luminance value of the pixel is represented by C. Therefore, in the obtained relationship between the pixel grayscale (pixel luminance value) and the display luminance, it can be seen that the corresponding grayscale value when the backlight signal value of the pixel is lower than the grayscale value when the backlight module is always on, that is, backlight luminance $L_1$, is subjected to transmittance compensation in a manner A, and the corresponding grayscale value when the backlight signal value of the pixel is higher than the grayscale value when the backlight module is always on, that is, backlight luminance $L_{pec}$, is subjected to transmittance compensation in a manner B or C, and the obtained display luminances $L_1$*A and $L_{pec}$*B (or C) have a uniform transition and continuous grayscale. The bright block problem caused by the brightness partition does not occur in the actual display image shown on the right side of FIG. 3B.

Figure 7:
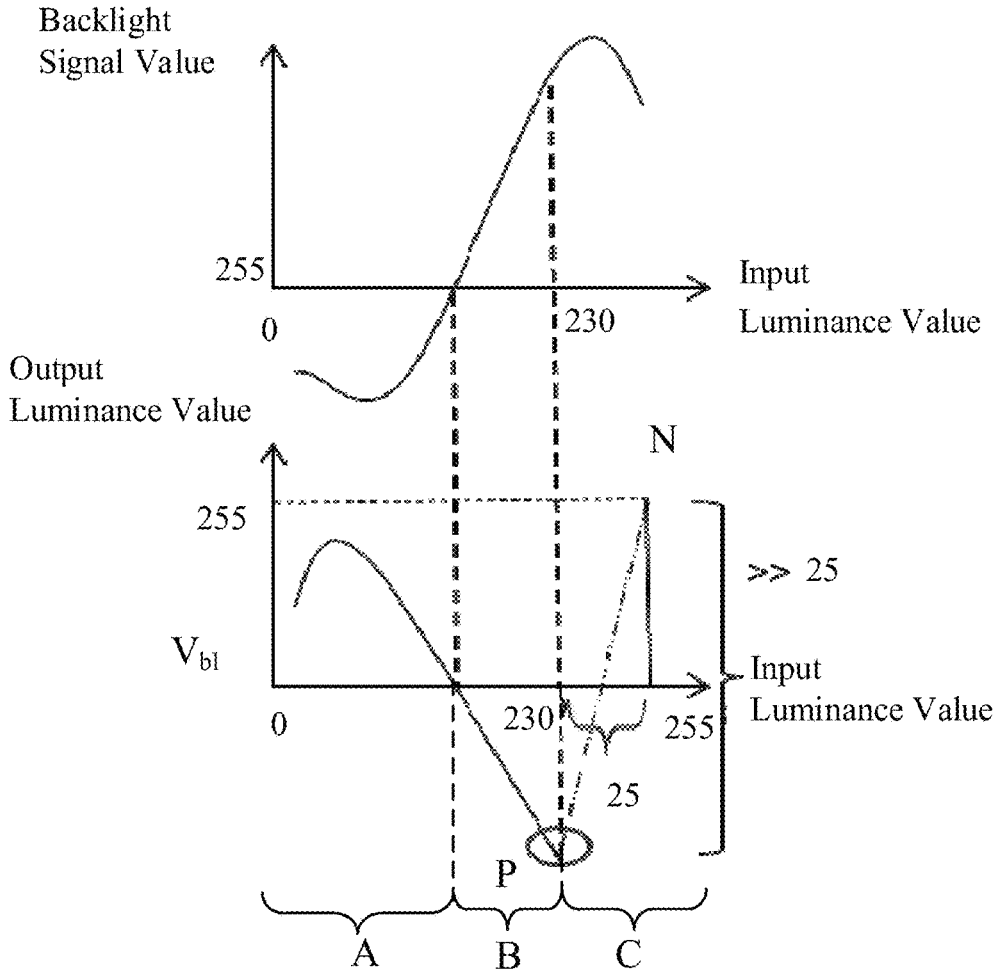
FIG. 7 is a schematic diagram of a principle of a three-stage compensation manner in a driving method of a display device according to some embodiments of the present disclosure.

Optionally, the corresponding grayscale value when the backlight module is always on is generally 255, and at this time, the luminance value corresponding to the transmittance is $V_{bl}$. As shown in FIG. 7, when step S603 of adjusting the output luminance value of the pixel is performed, during local dimming, the backlight signal value of the pixel is smaller than 255, and according to the criterion that the display luminance observed by human eyes before and after the change is unchanged, it can be obtained that the transmittance, that is, the output luminance value of the pixel needs to be correspondingly increased, that is, greater than $V_{bl}$. Therefore, when the output luminance value is adjusted according to the input luminance value, it is required to increase the output luminance value to be greater than $V_{bl}$, as shown in Segment A in the FIG. 7. When step S604 of adjusting the output luminance value of the pixel is performed, as the backlight signal value of the pixel is greater than 255 since the backlight luminance is affected by Peak, the transmittance should be correspondingly decreased based on the transmittance of the original image, that is, smaller than $V_{bl}$. Therefore, when the output luminance value is adjusted according to the input luminance value, it is required to decrease the output luminance value to be smaller than $V_{bl}$, as shown in Segment B in the figure. When step S605 of adjusting the output luminance value of the pixel is performed, as the backlight is multiplied to the driving area, in order to ensure the continuity of the transmittance, it is necessary to continuously transmit the transmittance from the point P to the point N in the figure, wherein the point P is the peak driving threshold. In the figure, the case that the value of the point P is 230 is taken as an example, the point N indicates that the corresponding output luminance value is also maximum when the input luminance value is maximum, for example, 255 respectively.

Based on this, optionally, in the driving method provided by the embodiment of the present disclosure, step S603 of increasing the output luminance value of the pixel based on the input luminance value of the pixel specifically includes:

determining, when it is determined that the backlight signal value of the pixel is lower than the corresponding grayscale value when the backlight module is always on, the output luminance value of the pixel according to the following formula (1):

$$V=V_0+(bl_{max}-bl_{psf})*V_0/N \quad (1);$$

wherein, V represents the output luminance value of the pixel, $V_0$ represents the input luminance value of the pixel, $bl_{psf}$ represents the backlight signal value of the pixel, $bl_{max}$ represents the maximum value in the backlight signal values of all the pixels, and N represents the corresponding grayscale value when the backlight module is always on, and is generally 255.

Optionally, in the driving method provided by the embodiment of the present disclosure, step S604 of decreasing the output luminance value of the pixel based on the input luminance value of the pixel specifically includes:

determining, when it is determined that the backlight signal value of the pixel is higher than the corresponding grayscale value when the backlight module is always on, and when the input luminance value of the pixel is smaller than the peak driving threshold, the output luminance value of the pixel according to the following formula 2a:

$$V=V_0*(N/bl_{psf}) \quad (2a);$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on, and is generally 255.

Optionally, in the driving method provided by the embodiment of the present disclosure, step S605 of linearly driving the output luminance value of the pixel based on the input luminance value of the pixel specifically includes:

determining, when it is determined that the backlight signal value of the pixel is higher than the corresponding grayscale value when the backlight module is always on, and when the input luminance value of the pixel is greater than the peak driving threshold, the output luminance value of the pixel according to the following formula 3a:

$$V=((N-T*(N/bl_{psf}Y))/(N-T))*(V_0-N)+N \quad (3a);$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on, and is generally 255.

Further, in order to solve the black dot problem in the display image caused by adopting the formulas (2a and 3a), the peak driving threshold can be decreased (shown as P point left shift in FIG. 7), and the output luminance values in the driving area C can be decreased (shown as P point up shift in FIG. 7). However, since the influence of the actual image on the peak driving threshold P cannot be too small, the formulas (2a and 3a) are improved from the angle of P point up shift.

Based on this, optionally, in the driving method provided by the embodiment of the present disclosure, step S604 of decreasing the output luminance value of the pixel based on the input luminance value of the pixel specifically includes:

determining, when it is determined that the backlight signal value of the pixel is higher than the corresponding grayscale value when the backlight module is always on, and when the input luminance value of the pixel is smaller than the peak driving threshold, the output luminance value of the pixel according to the following formula 2b:

$$V=V_0*((N+(bl_{psf}-N)/a)/bl_{psf})^{(1/\gamma)} \quad (2b);$$

wherein, V represents the output luminance value of the pixel, $V_0$ represents the input luminance value of the pixel, $bl_{psf}$ represents the backlight signal value of the pixel, a is a positive number greater than 1, for example, 1.2 can be selected, and the smaller the value of a, the better, $\gamma=2.2$, and N represents the corresponding grayscale value when the backlight module is always on, and is generally 255.

Optionally, in the driving method provided by the embodiment of the present disclosure, step S605 of linearly driving the output luminance value of the pixel based on the input luminance value of the pixel specifically includes:

determining, when it is determined that the backlight signal value of the pixel is higher than the corresponding grayscale value when the backlight module is always on, and when the input luminance value of the pixel is greater than the peak driving threshold, the output luminance value of the pixel according to the following formula 3b:

$$V=((N-T*(N+(bl_{psf}-N)/a)/bl_{psf})^{(1/\gamma)})/(N-T))*(V_0-N)+N \quad (3b);$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, for example, 1.2 can be selected, and the smaller the value of a, the better, $\gamma=2.2$, and N represents the corresponding grayscale value when the backlight module is always on, and is generally 255.

Figure 8:
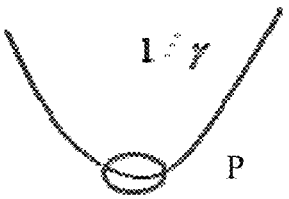
FIG. 8 is a partial enlarged view of the P point in FIG. 7.

The above formula 3b is a straight line expression calculated based on the formula 2a. There are two main improvements in formula 2b relative to 2a. The first improvement is to increase the value of P by changing the magnitude of the original backlight, that is, to shift the P point up; the second improvement is to add the power exponent $1/\gamma$, so that the transmittance curve is smooth at the P point, which makes the change in transmittance softer and the display effect better, and therefore, the black dot problem can be solved to achieve the final better HDR display effect. A detailed enlarged view of P point in FIG. 7 is shown in FIG. 8.

Based on the same inventive concept, some embodiments of the present disclosure further provide a driving device of a display device. Since the principle of solving the problem by the driving device is similar to that of the foregoing driving method, the implementation of the driving device can be implemented by referring to the implementation of the driving method, and will not be repeated herein.

Figure 9:
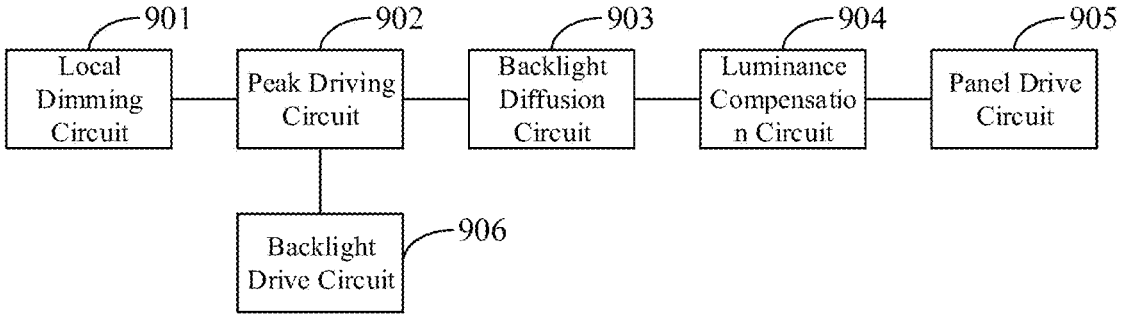
FIG. 9 is a structural schematic diagram of a driving device of a display device according to some embodiments of the present disclosure.

A driving device of a display device provided by the embodiment of the present disclosure, as shown in FIG. 9, includes:

a local dimming circuit 901, configured to determine, according to an input luminance value of each pixel in an input image to be displayed, a backlight signal value of each backlight area in a backlight module;

a peak driving circuit 902, configured to perform, under the condition that the total power consumption after the adjustment is smaller than the corresponding power consumption when the backlight module is always on, peak driving on at least part of backlight areas in which the backlight signal values are greater than a preset peak driving threshold;

a backlight diffusion circuit 903, configured to determine, according to a preset backlight diffusion function and the backlight signal value of each backlight area subjected to peak driving, a backlight signal value of each pixel corresponding to each backlight area;

a luminance compensation circuit 904, configured to determine, according to the backlight signal value of each pixel and the relationship between the corresponding grayscale value when the backlight module is always on and the peak driving threshold, an output luminance value of each pixel;

a panel drive circuit 905, configured to drive, according to the determined output luminance value of each pixel, a liquid crystal display panel; and a backlight drive circuit 906, configured to drive, according to the backlight signal value of each backlight area subjected to peak driving, the backlight module.

Optionally, in the driving device provided by the embodiment of the present disclosure, the peak driving circuit 902 is configured to determine, according to the backlight signal value of each backlight area and the corresponding grayscale value when the backlight module is always on, a maximum power consumption allowance; sort backlight areas of which the averages of the input luminance values of pixels are greater than the peak driving threshold P from high to low; and perform driving on the backlight signal values of all the sorted backlight areas one by one by a set multiple until confirming that the sum of all driving increments is smaller than the maximum power consumption allowance.

Optionally, in the driving device provided by the embodiment of the present disclosure, the luminance compensation circuit 904 is configured to increase, when it is determined that the backlight signal value of the pixel is lower than the corresponding grayscale value when the backlight module is always on, the output luminance value of the pixel based on the input luminance value of the pixel; decrease, when it is determined that the backlight signal value of the pixel is higher than the corresponding grayscale value when the backlight module is always on, and when the input luminance value of the pixel is smaller than the peak driving threshold, the output luminance value of the pixel based on the input luminance value of the pixel; and perform, when it is determined that the backlight signal value of the pixel is higher than the corresponding grayscale value when the backlight module is always on, and when the input luminance value of the pixel is greater than the peak driving threshold, linear driving on the output luminance value of the pixel based on the input luminance value of the pixel.

Optionally, in the driving device provided by the embodiment of the present disclosure, the luminance compensation circuit 904 is configured to determine, when it is determined that the backlight signal value of the pixel is lower than the corresponding grayscale value when the backlight module is always on, the output luminance value of the pixel according to the following formula:

$$V=V_0+(bl_{max}-bl_{psf})*V_0/N;$$

wherein, V represents the output luminance value of the pixel, $V_0$ represents the input luminance value of the pixel, $bl_{psf}$ represents the backlight signal value of the pixel, $bl_{max}$ represents the maximum value in the backlight signal values of all the pixels, and N represents the corresponding grayscale value when the backlight module is always on.

Optionally, in the driving device provided by the embodiment of the present disclosure, the luminance compensation circuit 904 is configured to determine, when it is determined that the backlight signal value of the pixel is higher than the corresponding grayscale value when the backlight module is always on, and when the input luminance value of the pixel is smaller than the peak driving threshold, the output luminance value of the pixel according to the following formula:

$$V=V_0*(N/bl_{psf});$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on.

Optionally, in the driving device provided by the embodiment of the present disclosure, the luminance compensation circuit 904 is specifically configured to determine, when it is determined that the backlight signal value of the pixel is higher than the corresponding grayscale value when the backlight module is always on, and when the input luminance value of the pixel is greater than the peak driving threshold, the output luminance value of the pixel according to the following formula:

$$V=((N-T*(N/bl_{psf}))/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on.

Optionally, in the driving device provided by the embodiment of the present disclosure, the luminance compensation circuit 904 is specifically configured to determine, when it is determined that the backlight signal value of the pixel is higher than the corresponding grayscale value when the backlight module is always on, and when the input luminance value of the pixel is smaller than the peak driving threshold, the output luminance value of the pixel according to the following formula:

$$V=V0*((N+(bl_{psf}-N)/a)/bl_{psf})^{(1/\gamma)};$$

wherein, V represents the output luminance value of the pixel, $V_0$ represents the input luminance value of the pixel, $bl_{psf}$ represents the backlight signal value of the pixel, a is a positive number greater than 1, and N represents the corresponding grayscale value when the backlight module is always on.

Optionally, in the driving device provided by the embodiment of the present disclosure, the luminance compensation circuit 904 is specifically configured to determine, when it is determined that the backlight signal value of the pixel is higher than the corresponding grayscale value when the backlight module is always on, and when the input luminance value of the pixel is greater than the peak driving threshold, the output luminance value of the pixel according to the following formula:

$$V=((N-T*(N+(bl_{psf}-N)/a)/bl_{psf})^{(1/\gamma)})/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, and N represents the corresponding grayscale value when the backlight module is always on.

Based on the same inventive concept, some embodiments of the present disclosure further provide a display device, including the foregoing driving device provided by the embodiment of the present disclosure. The display device may be: a mobile phone, a tablet computer, a television, a display, a notebook computer, a digital photo frame, a navigator or any product or part that has a display function. For the implementation of the display device, reference may be made to the embodiment of the foregoing driving device, and the repeated description is omitted herein.

Based on the same inventive concept, some embodiments of the present disclosure further provide a computer readable medium, including program code, wherein when the program code is run on a computing device, the program code is configured to enable the computing device to execute the steps of the foregoing driving method provided by the embodiment of the present disclosure. Since the principle of solving the problem by the computer readable medium is similar to that of the foregoing driving method of the display panel, the implementation of the computer readable medium can be referred to the implementation of the driving method, and the repeated description is omitted herein.

The program product may use any combination of one or more readable media. The readable medium may be a readable signal medium or a readable storage medium. The readable storage medium may be, for example, but not limited to, an electronic, magnetic, optical, electromagnetic, infrared, or semiconductor system, apparatus or device, or any combination of the foregoing. More specific examples (non-exhaustive lists) of the readable storage medium include: an electrical connection with one or more wires, a portable disk, a hard disk, a random access memory (RAM), a read only memory (ROM), an erasable programmable read-only memory (EPROM or flash memory), an optical fiber, a portable compact disk read only memory (CD-ROM), an optical storage device, a magnetic storage device, or any suitable combination of the foregoing.

A display product according to an implementation manner of the present disclosure may employ a portable compact disk read only memory (CD-ROM) and include program code, and may run on a server device. However, the program product of the present disclosure is not limited thereto, and in the present document, the readable storage medium may be any tangible medium containing or storing a program that can be used by or in combination with an information transmission apparatus or device.

The readable signal medium may include a data signal that is propagated in the baseband or as part of a carrier, carrying readable program code. Such propagated data signals can take a variety of forms including, but not limited to, electromagnetic signals, optical signals, or any suitable combination of the foregoing. The readable signal medium may also be any readable medium other than a readable storage medium that can transmit, propagate or transport a program for use by or in connection with a periodic network action system, apparatus or device or a combination thereof.

Program code embodied on a readable medium can be transmitted by any suitable medium, including but not limited to, wireless, wire, optical cable, RF, etc., or any suitable combination of the foregoing.

Program code for performing the operations of the present disclosure can be written in any combination of one or more programming languages, including object oriented programming language, such as Java, C++, etc., as well as conventional procedural programming language, such as the "C" language or a similar programming language. The program code can be executed entirely on the user computing device, executed partially on the user device, executed as a stand-alone software package, executed partially on the user computing device and partially on the remote computing device, or executed entirely on the remote computing device or server. In a case involving a remote computing device, the remote computing device can be connected to the user computing device, or can be connected to an external computing device via any kind of network, including a local area network (LAN) or wide area network (WAN).

Through the description of the above implementation manners, those skilled in the art can clearly understand that the embodiments of the present disclosure can be implemented by hardware, or can also be implemented by means of software plus a necessary general hardware platform. Based on this understanding, the technical solution of the embodiment of the present disclosure may be embodied in the form of a software product, which may be stored in a non-volatile storage medium (which may be a CD-ROM, a USB flash drive, a mobile hard disk, etc.), including a plurality of instructions for causing a computer device (which may be a personal computer, server, or network device, etc.) to perform the methods of various embodiments of the present disclosure.

A person skilled in the art can understand that the drawings are only a schematic diagram of an optional embodiment, and the modules or processes in the drawings are not necessarily required to implement the present disclosure.

A person skilled in the art can understand that the modules in the device in the embodiment can be distributed in the device of the embodiment according to the description of the embodiment, or the corresponding changes can be located in one or more devices different from the present embodiment. The modules of the above embodiments may be combined into one module, or may be further split into multiple sub-modules.

The serial numbers of the embodiments of the present disclosure are merely for the description, and do not represent the quality of the embodiments.

According to the driving method and driving device of the display device, and a related device provided by the embodiments of the present disclosure, after the backlight signal value of the backlight area is subjected to peak driving, the backlight signal value of each backlight area subjected to peak driving is subjected to backlight diffusion to obtain the backlight signal value of each pixel, and then the output luminance value of each pixel is determined according to the backlight signal value of each pixel and the relationship between the corresponding grayscale value when the backlight module is always on and the peak driving threshold, so as to perform display control. When transmittance compensation is performed, that is, when the output luminance value of each pixel is determined, the backlight signal value of each backlight area subjected to peak driving is adopted, and therefore, as compared to the existing addition compensation that can only deal with backlight reduction, the backlight signal value of any backlight change can be compensated, so that the adjusted transmittance and the backlight change match each other, thereby avoiding the bright block problem and further improving the display effect.

It will be apparent that those skilled in the art can make various modifications and variations to the present disclosure without departing from the spirit and scope of the present disclosure. Thus, if such modifications and variations of the present disclosure fall within the scope of the claims of the present disclosure and the equivalents thereof, the present disclosure is also intended to cover such modifications and variations.

The invention claimed is:

1. A driving method of a display device, the method comprising:

determining, according to an input luminance value of each pixel in an input image to be displayed, a backlight signal value of each backlight area in a backlight module;

determining, according to the backlight signal value of each of the backlight areas and the corresponding grayscale value when the backlight module is always on, a maximum power consumption allowance;

sorting backlight areas of which the averages of the input luminance values of pixels are greater than the peak driving threshold from high to low; and performing driving on the backlight signal values of all sorted backlight areas one by one by a set multiple until confirming that a sum of all driving increments is smaller than the maximum power consumption allowance;

determining, according to a preset backlight diffusion function and the backlight signal value of each of the backlight areas subjected to peak driving, a backlight signal value of each pixel corresponding to each of the backlight areas;

determining, according to the backlight signal value of each of the pixels and a relationship between a corresponding grayscale value when the backlight module is always on and the peak driving threshold, an output luminance value of each of the pixels; and driving, according to determined output luminance value of each of the pixels, a liquid crystal display panel; and driving, according to the backlight signal value of each of the backlight areas subjected to peak driving, the backlight module.

2. The driving method according to claim 1, wherein the determining, according to the backlight signal value of each of the pixels and the relationship between the corresponding grayscale value when the backlight module is always on and the peak driving threshold, an output luminance value of each of the pixels, comprises:

increasing, in response to that the backlight signal value of the pixel is lower than the corresponding grayscale value when the backlight module is always on, the output luminance value of the pixel based on the input luminance value of the pixel;

decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel; and performing, in response to that the backlight signal value of the pixel is higher than the corresponding grayscale value when the backlight module is always on, and the input luminance value of the pixel is greater than the peak driving threshold, linear driving on the output luminance value of the pixel on the basis of the input luminance value of the pixel.

3. The driving method according to claim 2, wherein the increasing, in response to that the backlight signal value of the pixel is lower than the corresponding grayscale value when the backlight module is always on, the output luminance value of the pixel based on the input luminance value of the pixel, comprises:

determining, in response to that that the backlight signal value of the pixel is lower than the corresponding grayscale value when the backlight module is always on, the output luminance value of the pixel according to a following formula:

$$V=V_0+(bl_{max}-bl_{psf})*V_0/N;$$

wherein, V represents the output luminance value of the pixel, $V_0$ represents the input luminance value of the pixel, $bl_{psf}$ represents the backlight signal value of the pixel, $bl_{max}$ represents a maximum value in the backlight signal values of all the pixels, and N represents the corresponding grayscale value when the backlight module is always on.

4. The driving method according to claim 2, wherein the decreasing, in response to that the backlight signal value of the pixel is higher than the corresponding grayscale value when the backlight module is always on, and the input luminance value of the pixel is smaller than the peak driving threshold, the output luminance value of the pixel on based on the input luminance value of the pixel, comprises:

determining, in response to that the backlight signal value of the pixel is higher than the corresponding grayscale value when the backlight module is always on, and the input luminance value of the pixel is smaller than the peak driving threshold, the output luminance value of the pixel according to a following formula:

$$V=V_0*(N/bl_{psf});$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on.

5. The driving method according to claim 4, wherein the performing, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, comprises:

determining, in response to that the backlight signal value of the pixel is higher than the corresponding grayscale value when the backlight module is always on, and the input luminance value of the pixel is greater than the peak driving threshold, the output luminance value of the pixel according to a following formula:

$$V=((N-T*(N/bl_{psf}))/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on.

6. The driving method according to claim 2, wherein the decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel, comprises:

determining, in response to that the backlight signal value of the pixel is higher than the corresponding grayscale value when the backlight module is always on, and the input luminance value of the pixel is smaller than the peak driving threshold, the output luminance value of the pixel according to a following formula:

$$V=V_0*((N+(bl_{psf}-N)/a)/bl_{psf})^{(1/\gamma)};$$

wherein, V represents the output luminance value of the pixel, $V_0$ represents the input luminance value of the pixel, $bl_{psf}$ represents the backlight signal value of the pixel, a is a positive number greater than 1, and N represents the corresponding grayscale value when the backlight module is always on.

7. The driving method according to claim 6, wherein the performing, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, comprises:

determining, in response to that the backlight signal value of the pixel is higher than the corresponding grayscale value when the backlight module is always on, and the input luminance value of the pixel is greater than the peak driving threshold, the output luminance value of the pixel according to a following formula:

$$V=((N-T*(N+(bl_{psf}-N)/a)/bl_{psf})^{(1/\gamma)})/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, and N represents the corresponding grayscale value when the backlight module is always on.

8. A non-transitory computer readable medium, comprising program codes, wherein when the program codes are run on a computing device, the program codes are configured to enable the computing device to execute the driving method according to claim 1.

9. A driving device of a display device, the driving device comprises a memory configured to store a computer readable program, and a processor, wherein the processor is configured to read the computer-readable program to perform following method steps:

determining, according to an input luminance value of each pixel in an input image to be displayed, a backlight signal value of each backlight area in a backlight module;

determining, according to the backlight signal value of each of the backlight areas and the corresponding grayscale value when the backlight module is always on, a maximum power consumption allowance;

sorting backlight areas of which the averages of the input luminance values of pixels are greater than the peak driving threshold from high to low; and performing driving on the backlight signal values of all sorted backlight areas one by one by a set multiple until confirming that a sum of all driving increments is smaller than the maximum power consumption allowance;

determining, according to a preset backlight diffusion function and the backlight signal value of each of the backlight areas subjected to peak driving, a backlight signal value of each pixel corresponding to each of the backlight areas;

determining, according to the backlight signal value of each of the pixels and a relationship between a corresponding grayscale value when the backlight module is always on and the peak driving threshold, an output luminance value of each of the pixels; and driving, according to determined output luminance value of each of the pixels, a liquid crystal display panel; and driving, according to the backlight signal value of each of the backlight areas subjected to peak driving, the backlight module.

10. The driving device according to claim 9, wherein the processor is configured to read the computer-readable program to determine, according to the backlight signal value of each of the pixels and the relationship between the corresponding grayscale value when the backlight module is always on and the peak driving threshold, an output luminance value of each of the pixels, by:

increasing, in response to that the backlight signal value of the pixel is lower than the corresponding grayscale value when the backlight module is always on, the output luminance value of the pixel based on the input luminance value of the pixel;

decreasing, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel; and performing, in response to that the backlight signal value of the pixel is higher than the corresponding grayscale value when the backlight module is always on, and the input luminance value of the pixel is greater than the peak driving threshold, linear driving on the output luminance value of the pixel on the basis of the input luminance value of the pixel.

11. The driving device according to claim 10, wherein the processor is configured to read the computer-readable program to increase, in response to that the backlight signal value of the pixel is lower than the corresponding grayscale value when the backlight module is always on, the output luminance value of the pixel based on the input luminance value of the pixel, by:

determining, in response to that that the backlight signal value of the pixel is lower than the corresponding grayscale value when the backlight module is always on, the output luminance value of the pixel according to a following formula:

$$V=V_0+(bl_{max}-bl_{psf})*V_0/N;$$

wherein, V represents the output luminance value of the pixel, $V_0$ represents the input luminance value of the pixel, $bl_{psf}$ represents the backlight signal value of the pixel, $bl_{max}$ represents a maximum value in the backlight signal values of all the pixels, and N represents the corresponding grayscale value when the backlight module is always on.

12. The driving device according to claim 10, wherein the processor is configured to read the computer-readable program to decrease, in response to that the backlight signal value of the pixel is higher than the corresponding grayscale value when the backlight module is always on, and the input luminance value of the pixel is smaller than the peak driving threshold, the output luminance value of the pixel on based on the input luminance value of the pixel, by:

determining, in response to that the backlight signal value of the pixel is higher than the corresponding grayscale value when the backlight module is always on, and the input luminance value of the pixel is smaller than the peak driving threshold, the output luminance value of the pixel according to a following formula:

$$V=V_0*(N/bl_{psf});$$

wherein, V represents the output luminance value of the pixel, $V_0$ represents the input luminance value of the pixel, $bl_{psf}$ represents the backlight signal value of the pixel, and N represents the corresponding grayscale value when the backlight module is always on.

13. The driving device according to claim 12, wherein the processor is configured to read the computer-readable program to perform, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, by:

determining, in response to that the backlight signal value of the pixel is higher than the corresponding grayscale value when the backlight module is always on, and the input luminance value of the pixel is greater than the peak driving threshold, the output luminance value of the pixel according to a following formula:

$$V=((N-T*(N/bl_{psf}))/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, and N represents the corresponding grayscale value when the backlight module is always on.

14. The driving device according to claim 10, wherein the processor is configured to read the computer-readable program to decrease, in response to that the backlight signal value of the pixel is higher than the corresponding grayscale value when the backlight module is always on, and the input luminance value of the pixel is smaller than the peak driving threshold, the output luminance value of the pixel based on the input luminance value of the pixel, by:

determining, in response to that the backlight signal value of the pixel is higher than the corresponding grayscale value when the backlight module is always on, and the input luminance value of the pixel is smaller than the peak driving threshold, the output luminance value of the pixel according to a following formula:

$$V=V_0*((N+(bl_{psf}-N)/a)/bl_{psf}^{(1/\gamma)};$$

wherein, V represents the output luminance value of the pixel, $V_0$ represents the input luminance value of the pixel, $bl_{psf}$ represents the backlight signal value of the pixel, a is a positive number greater than 1, and N represents the corresponding grayscale value when the backlight module is always on.

15. The driving device according to claim 14, wherein the processor is configured to read the computer-readable program to perform, in response to that the backlight signal value of the pixel is higher than the corresponding grayscale value when the backlight module is always on, and the input luminance value of the pixel is greater than the peak driving threshold, linear driving on the output luminance value of the pixel based on the input luminance value of the pixel, by:

determining, in response to that the backlight signal value of the pixel is higher than the corresponding grayscale value when the backlight module is always on, and the input luminance value of the pixel is greater than the peak driving threshold, the output luminance value of the pixel according to a following formula:

$$V=((N-T*(N+(bl_{psf}-N)/a)/bl_{psf})^{(1/\gamma)})/(N-T))*(V_0-N)+N;$$

wherein, V represents the output luminance value of the pixel, $V_0$ represents the input luminance value of the pixel, $bl_{psf}$ represents the backlight signal value of the pixel, T represents the peak driving threshold, a is a positive number greater than 1, and N represents the corresponding grayscale value when the backlight module is always on.

16. A display device, comprising the driving device according to claim 9.

* * * * *